US006896484B2

(12) United States Patent
Diakunchak

(10) Patent No.: US 6,896,484 B2
(45) Date of Patent: May 24, 2005

(54) TURBINE ENGINE SEALING DEVICE

(75) Inventor: Ihor S. Diakunchak, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 20 days.

(21) Appl. No.: 10/661,699

(22) Filed: Sep. 12, 2003

(65) Prior Publication Data

US 2005/0058540 A1 Mar. 17, 2005

(51) Int. Cl.[7] ..... F01D 11/08
(52) U.S. Cl. ..... 415/173.1; 416/189; 416/191
(58) Field of Search ..... 415/136, 173.1; 416/189, 191

(56) References Cited

U.S. PATENT DOCUMENTS

| | | | | |
|---|---|---|---|---|
| 3,756,738 A | | 9/1973 | Lee | |
| 3,982,850 A | | 9/1976 | Jenkinson | |
| 4,050,843 A | * | 9/1977 | Needham et al. | 415/136 |
| 4,527,385 A | | 7/1985 | Jumelle et al. | |
| 4,557,704 A | | 12/1985 | Ito et al. | |
| 4,578,942 A | | 4/1986 | Weiler | |
| 5,098,257 A | | 3/1992 | Hultgren et al. | |
| 5,161,908 A | | 11/1992 | Yoshida et al. | |
| 5,228,828 A | * | 7/1993 | Damlis et al. | 415/173.2 |
| 5,333,993 A | | 8/1994 | Stueber et al. | |
| 6,072,661 A | | 6/2000 | Schirle | |
| 6,206,378 B1 | | 3/2001 | Sakata et al. | |
| 6,406,256 B1 | | 6/2002 | Marx | |
| 6,463,729 B2 | | 10/2002 | Magoshi et al. | |
| 6,733,235 B2 | * | 5/2004 | Alford et al. | 416/191 |

FOREIGN PATENT DOCUMENTS

GB 2381048 A 4/2003

* cited by examiner

*Primary Examiner*—F. Daniel Lopez
*Assistant Examiner*—Igor Kershteyn

(57) ABSTRACT

A sealing system for reducing a gap between a tip of a turbine blade and a shroud of a turbine engine. As a turbine engine reaches steady state operating conditions, components of the sealing system reach their maximum expansion and reduce the size of the gap located between the blade tips and the engine shroud, thereby reducing the leakage of air past the turbine blades and increasing the efficiency of the turbine engine. The sealing system includes a ring segment having a sealing surface positioned proximate to a tip of a turbine blade. The ring segment may be coupled to a blade ring using a spindle having a coefficient of thermal expansion greater than the coefficient of thermal expansion for the blade ring.

16 Claims, 2 Drawing Sheets

TURBINE ENGINE SEALING DEVICE

FIELD OF THE INVENTION

This invention is directed generally to turbine engines, and more particularly to systems for sealing gaps between blade tips and shrouds in turbine engines.

BACKGROUND

Typically, gas turbine engines are formed from a combustor positioned upstream from a turbine blade assembly. The turbine blade assembly is formed from a plurality of turbine blade stages coupled to discs that are capable of rotating about a longitudinal axis. Each turbine blade stage is formed from a plurality of blades extending radially about the circumference of the disc. Each stage is spaced apart from each other a sufficient distance to allow turbine vanes to be positioned between each stage. The turbine vanes are typically coupled to the shroud and remain stationary during operation of the turbine engine.

The tips of the turbine blades are located in close proximity to an inner surface of the shroud of the turbine engine. There typically exists a gap between the blade tips and the shroud of the turbine engine so that the blades may rotate without striking the shroud. During operation, high temperature and high pressure gases pass the turbine blades and cause the blades and disc to rotate. These gases also heat the shroud and blades and discs to which they are attached causing each to expand due to thermal expansion. After the turbine engine has been operating at full load conditions for a period of time, the components reach a maximum operating condition at which maximum thermal expansion occurs. In this state, it is desirable that the gap between the blade tips and the shroud of the turbine engine be as small as possible to limit leakage past the blade tips.

However, reducing the gap cannot be accomplished by simply positioning the components so that the gap is minimal under full load conditions because the configuration of the components forming the gap must account for emergency shutdown conditions in which the shroud, having less mass than the turbine blade and disc assembly, cools faster than the turbine blade assembly. In emergency shutdown conditions, the diameter of the shroud reduces at a faster rate than the length of the turbine blades. Therefore, unless the components have been positioned so that a sufficient gap has been established between the turbine blades and the turbine shroud under operating conditions, the turbine blades strike the shroud because the diameter of the shroud is reduced at a faster rate than the turbine blades. Collision of the turbine blades and the shroud often causes catastrophic results. Thus, a need exists for a system for reducing gaps between turbine blade tips and a surrounding shroud under full load operating conditions while accounting for necessary clearance under emergency shutdown conditions.

SUMMARY OF THE INVENTION

This invention relates to a sealing system for reducing a gap between a tip of a turbine blade and a shroud of a turbine engine. As a turbine engine reaches steady state operation, components of the sealing system reach their maximum expansion and reduce the size of the gap located between the blade tips and the engine shroud, thereby reducing the leakage of air past the turbine blades and increasing the efficiency of the turbine engine. In at least one embodiment, the sealing system includes a turbine blade assembly having at least one stage formed from a plurality of turbine blades. The sealing system also includes a blade ring radially surrounding the turbine blade assembly such that the blade ring may radially expand and contract during operation as a result of thermal expansion or contraction. A ring segment having at least one surface positioned in close proximity to at least one tip of the turbine blade assembly may be positioned such that the ring segment forms a gap between the at least one surface of the ring segment and the plurality of blades. A spindle may be fixed to the blade ring at a first end of the spindle and coupled to the ring segment at a second end of the spindle for supporting and positioning the ring segment in close proximity with at least one tip of the plurality of blades. The spindle may be formed from a material having a coefficient of thermal expansion that is greater than a coefficient of thermal expansion for a material forming the ring segment.

While the turbine engine is at rest, there exists a gap between the blade tips and the ring segments. During operation, the ring segments reach maximum operating temperature before the turbine blade assembly. As the ring segments are heated, the spindle lengthens a greater amount than the blade ring. In other words, the length of the spindle increases a greater distance than the diameter of the blade ring increases. As a result, the ring segment attached to the end of the spindle undergoes a net radial displacement towards the tips of the blades. As the turbine blade assembly reaches its maximum operating temperature, the blades lengthen to their steady state operating positions. Operating a turbine engine using this sealing system reduces the gap between the tips of the turbine blades and the ring segments by about 0.04 inches to about 0.05 inches, depending on the difference in thermal expansion coefficients between the spindle and the blade ring. The larger the difference in coefficients of the spindle and the blade ring, the larger the reduction in gap spacing. Upon shutdown, even in emergency conditions, the ring segment undergoes a net radial displacement away from the blade tips, thereby preventing the blade tips from contacting the ring segments.

An advantage of this invention is that the size of the gap between blade tips and shrouds of turbine engines may be reduced without introducing the possibility that the blade tips may contact the shroud, thereby damaging the turbine engine.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
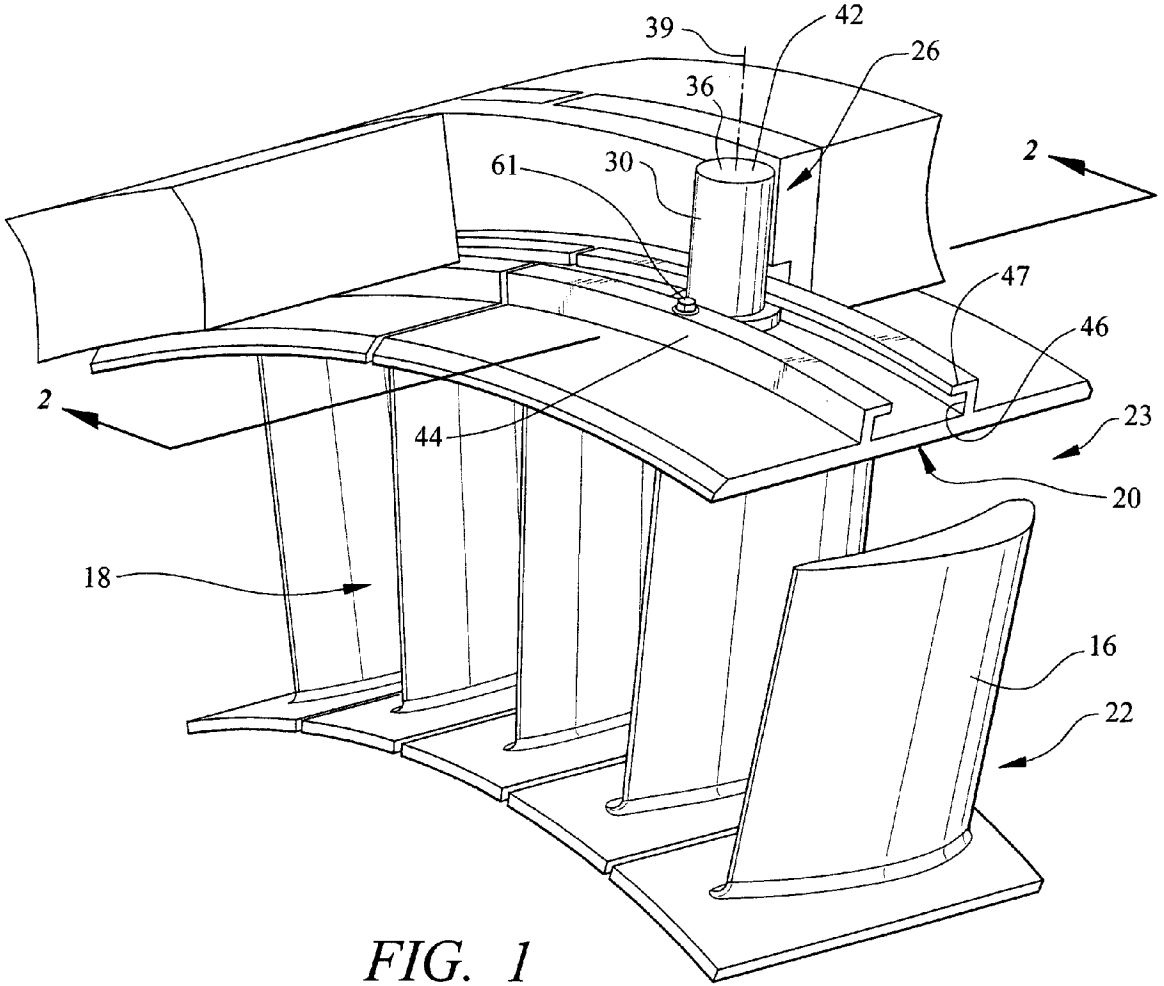
FIG. 1 is a perspective view of an embodiment of this invention.
Figure 2:
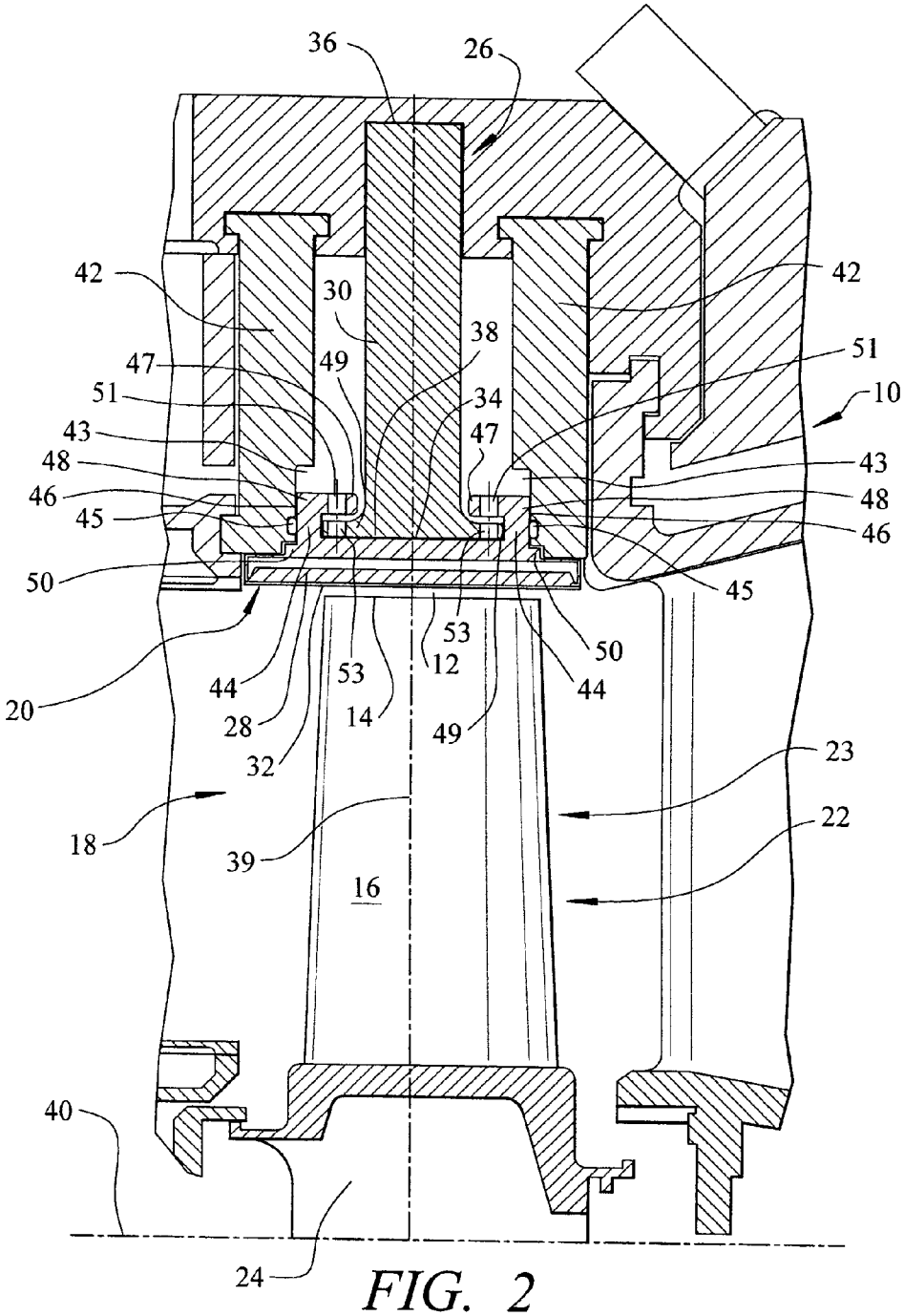
FIG. 2 is a side view of the embodiment of this invention taken at 2—2 in FIG. 1.

As shown in FIGS. 1–2, this invention is directed to a sealing system 10 for a turbine engine. In particular, the sealing system 10 is operable to reduce a gap 12 between one or more tips 14 of a turbine blade 16 in a turbine engine 18 and a surrounding shroud 20 while the turbine engine 18 is operating. The gap 12 exists in the turbine engine 18 so that the tips 14 do not contact the shroud 20. In at least one embodiment, the turbine engine 18 includes a turbine blade assembly 22 formed at least in part from a plurality of turbine blades 16 coupled to a disc 24. The blades 16 may be coupled to the disc 24 at various points along the disc 24 and may be assembled into rows, which are commonly referred to as stages 23, having adequate spacing to accommodate stationary vanes between adjacent stages of the blades 16. The stationary vanes are typically mounted to a casing of the turbine engine 18. The disc 24 may be rotatably coupled to the turbine engine 18.

The turbine engine 18 may also include a plurality of blade rings 26. The blade rings 26 may be positioned radially surrounding the turbine blade assembly 22 such that the blade ring 26 may radially expand and contract during operation as a result of thermal expansion or contraction. The size and configuration of the blade rings 26 depend on the size and configuration of the turbine engine 18.

A ring segment 28 may be coupled to a blade ring 26 using a spindle 30. The ring segment 28 may have at least one sealing surface 32 positioned in close proximity to at least one tip 14 of the plurality of turbine blades 16 of the turbine blade assembly 22. The ring segment 28 may be positioned so that a gap 12 is formed between the tips 14 of the turbine blades 16 and the ring segment 28.

In at least one embodiment, the ring segment 28 may be supported by a single spindle 30. The spindle 30 may be attached to the ring segment 28 substantially at a center point 34 of the ring segment 28. The spindle 30 may be fixed to the blade ring 26 at a first end 36 and coupled to the ring segment 28 at a second end 38 for supporting and positioning the ring segment 28 in close proximity with at least one tip 14 of the plurality of turbine blades 16. The spindle 30 may be fixed to the blade ring 26 at the first end 36 using one or more bolts, welds, interference fits, or other appropriate mechanical connectors. The spindle 30 may be fixed so that as the temperature of the spindle 30 increases, and the length of the spindle 30 thereby increases. As a result, the second end 38 of the spindle 30 extends from the blade ring 26. In at least one embodiment, the turbine blades 16 are substantially of equal lengths and the ring segment 28 is positioned in close proximity to all of the tips 14 of the turbine blades 16. In at least one embodiment, the spindle 30 may be positioned substantially parallel to a radial axis 39 extending from an axis of rotation 40 of the turbine blade assembly 22. Spindle 30 may be formed from a material having a coefficient of thermal expansion greater than a coefficient of thermal expansion for the material forming the blade ring 26. For instance and not by way of limitation, the spindle 30 may be formed from A286 disc alloy having a coefficient of thermal expansion of about 9.7 inch per inch per degree Fahrenheit, and the blade ring 26 may be formed from IN909 having a coefficient of thermal expansion of about 4.5 inch per inch per degree Fahrenheit.

In at least one embodiment, as shown in FIG. 2, a web 44 may be coupled to the ring segment 28 and extend away from the sealing surface 32. As shown in FIG. 1, the web 44 may extend circumferentially around the axis of rotation 40 of the turbine blade assembly 22. As shown in FIG. 2, the web 44 may extend from the ring segment 28 such that the web 44 may be substantially parallel to the spindle 30. The web 44 may also include a sealing portion 46 that may be generally parallel to the sealing surface 32 of the ring segment 28 and a hook 47 at a first end 48 that is opposite to the second end 50 coupled to the ring segment 28. The spindle 30 may be coupled to the ring segment 28 using one or more bolts 61, or other suitable releasable mechanical connections. In particular, a mechanical connector (not shown) may be passed through an orifice 51 in the hook 47 and an orifice 53 in a flange 49 of the spindle 30 and coupled to the ring segment 28 to attach the ring segment 28 to the spindle 30. In alternative embodiments, the hook 47 may be discontinuous and may be present at intermittent locations along the length of the web 44.

Under steady state operating conditions, the web 44 may thermally expand toward an isolation ring 42 and seal the ring segment 28 to the isolation ring 42 using a seal 45. The seal 45 may be, but is not limited to, a spring seal, or other seal capable of withstanding the high temperatures present in the turbine engine 18. The isolation ring 42 may extend circumferentially around the axis of rotation 40 of the turbine blade assembly 22. The isolation ring 42 may be used to seal the ring segment 28 to the supporting turbine components. The isolation ring 42 may include one or more channels 43 for positioning the seal 45 between the ring segment 28 and the isolation ring 42.

During operation, the temperature of the turbine engine 18 increases, which causes the blade ring 26, the ring segment 28, and the turbine blades 16 forming the turbine blade assembly 22 to heat up. Each of the blade ring 26, the ring segment 28, and the turbine blades 16 expand as the temperature of each component increases. In particular, as the temperature of the turbine engine 18 increases, the length of each turbine blade 16, the diameter of the blade ring 26, and the length of the spindle 30 increase. Because the coefficient of thermal expansion of the spindle 30 is greater than the coefficient of thermal expansion of the blade ring 26, the ring segment 28 coupled to the spindle 30 undergoes a net positive radial displacement towards the tips 14 of the turbine blades 16 even though the diameter of the blade ring 26 is increasing. In other words, as the tip of the blades 16 lengthen towards the ring segment 28, the sealing surface 32 of the ring segment 28 extends towards the tip of the turbine blades 16. This configuration results in a steady state, hot running blade tip clearance reduction of between about 0.04 inches and about 0.05 inches, depending on the difference in coefficients of thermal expansion between the spindle 30 and the blade ring 26.

In the event the turbine engine 18 is shutdown quickly, such as during emergency shutdown, the spindle 30 cools more quickly than the turbine blade assembly 22 because the spindle 30 has less mass than the turbine blade assembly 22. As the spindle 30 cools, the ring segments 28 may be withdrawn toward the blade ring 26 so that the sealing surface 32 of the ring segment 28 does not contact the tips 14 of the turbine blades 16. Because the coefficient of thermal expansion of the spindle 30 is greater than the coefficient of thermal expansion of the blade ring 26, the spindle 30 is retracted a greater distance than the distance that the blade ring 26 is reduced as the blade ring 26 cools. Thus, the gap 12 between the tips 14 of the turbine blades 16 and the sealing surface 32 of the ring segment 28 is increased as the temperature of the turbine engine 18 is reduced.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A sealing system for reducing a gap between a tip of a turbine blade and a shroud of a turbine engine, comprising:

a turbine blade assembly having at least one stage formed from a plurality of turbine blades;

a blade ring radially surrounding the turbine blade assembly such that the blade ring may radially expand and contract during operation as a result of thermal expansion or contraction;

a ring segment having at least one ring segment sealing surface positioned in close proximity to at least one tip of the plurality of turbine blades of the turbine blade assembly such that the ring segment forms a gap between the at least one ring segment sealing surface and the plurality of blades;

a spindle fixed to the blade ring at a first end of the spindle and coupled to the ring segment at a second end of the spindle for supporting and positioning the ring segment in close proximity with at least one tip of the plurality of blades; and wherein the spindle is formed from a material having a coefficient of thermal expansion that is greater than a coefficient of thermal expansion for a material forming the blade ring.

2. The sealing system of claim 1, wherein the spindle is substantially parallel to a radial axis extending from an axis of rotation of the turbine blade assembly.

3. The sealing system of claim 1, wherein the ring segment is supported solely by a single spindle.

4. The sealing system of claim 3, wherein the ring segment is supported solely by a single spindle coupled to the ring segment substantially at a center point of the ring segment.

5. The sealing system of claim 1, further comprising an isolation ring positioned between the ring segment and the blade ring and at least one web coupled to the ring segment for sealing the ring segment to the isolation ring.

6. The sealing system of claim 1, wherein the at least one web coupled to the ring segment extends away from the at least one ring segment sealing surface, is substantially parallel to the spindle, and has a sealing portion at a first end of the at least one web, which is opposite to a second end of the at least one web coupled to the ring segment, that is generally parallel with the at least one ring segment sealing surface.

7. The sealing system of claim 1, wherein the at least one ring segment sealing surface is substantially parallel with at least one tip of at least one blade of the plurality of blades forming the blade assembly.

8. A sealing system for reducing a gap between a tip of a turbine blade and a shroud of a turbine engine, comprising:

a turbine blade assembly having at least one stage formed from a plurality of turbine blades;

a blade ring radially surrounding the turbine blade assembly such that the blade ring may radially expand and contract during operation as a result of thermal expansion or contraction;

a ring segment having at least one ring segment sealing surface positioned in close proximity to at least one tip of the plurality of turbine blades of the turbine blade assembly such that the ring segment forms a gap between the at least one ring segment sealing surface and the plurality of blades;

a spindle fixed to the blade ring at a first end of the spindle and coupled to the ring segment at a second end of the spindle for supporting and positioning the ring segment in close proximity with at least one tip of the plurality of blades;

wherein the spindle is substantially parallel to a radial axis extending from an axis of rotation of the turbine blade assembly; and wherein the spindle is formed from a material having a coefficient of thermal expansion that is greater than a coefficient of thermal expansion for a material forming the blade ring.

9. The sealing system of claim 8, wherein the ring segment is supported solely by a single spindle.

10. The sealing system of claim 9, wherein the ring segment is supported solely by a single spindle coupled to the ring segment substantially at a center point of the ring segment.

11. The sealing system of claim 8, further comprising an isolation ring positioned between the ring segment and the blade ring and at least one web coupled to the ring segment for sealing the ring segment to the isolation ring.

12. The sealing system of claim 8, wherein the at least one web coupled to the ring segment extends away from the at least one ring segment sealing surface, is substantially parallel to the spindle, and has a sealing portion at a first end of the at least one web, which is opposite to a second end of the at least one web coupled to the ring segment, that is generally parallel with the at least one ring segment sealing surface.

13. The sealing system of claim 8, wherein the at least one ring segment sealing surface is substantially parallel with at least one tip of at least one blade of the plurality of blades forming the blade assembly.

14. A method for reducing a gap between a tip of a turbine blade in a turbine engine and a ring segment forming a portion of a shroud surrounding the turbine blade, comprising:

coupling a blade ring to a turbine casing such that the blade ring may radially expand and contract during operation as a result of thermal expansion or contraction and surrounds the plurality of turbine blades of the turbine blade assembly;

coupling a ring segment to the blade ring using a spindle, wherein the spindle is coupled to the blade ring at a first end of the spindle and is coupled to the ring segment at a second end of the spindle for supporting the ring segment and positioning at least one ring segment sealing surface of the ring segment in close proximity with at least one tip of the turbine blade to form a gap, wherein the spindle is formed from a material having a coefficient of thermal expansion that is greater than a coefficient of thermal expansion for a material forming the blade ring; and heating at least the ring segment and the spindle, which causes the spindle to lengthen at a greater rate than the blade ring and move the at least one ring segment sealing surface.

15. The method of claim 14, wherein coupling the ring segment to the blade ring using a spindle further comprises using a spindle positioned substantially parallel to a radial axis extending from an axis of rotation of the turbine blade assembly.

16. The method of claim 14, wherein coupling the ring segment to the blade ring using a spindle further comprises attaching the spindle to the center of the ring segment.

* * * * *